United States Patent [19]

Le Therisien

[11] 4,440,524

[45] Apr. 3, 1984

[54] PROCESS FOR BRINGING A BODY OF WATER INTO COMMUNICATION WITH A TUNNEL

[75] Inventor: Louis Le Therisien, Paris, France

[73] Assignee: Compagnie Francaise des Petroles, Paris, France

[21] Appl. No.: 263,384

[22] Filed: May 13, 1981

[30] Foreign Application Priority Data

May 16, 1980 [FR] France ..... 80 10997

[51] Int. Cl.[3] ..... F16L 1/04; E21D 10/16

[52] U.S. Cl. ..... 405/154; 405/137

[58] Field of Search ..... 405/132, 136, 137, 138, 405/158, 169, 303, 144, 154

[56] References Cited

U.S. PATENT DOCUMENTS

| | | | |
|---|---|---|---|
| 4,036,024 | 7/1977 | Dreker et al. | 405/144 X |
| 4,076,130 | 2/1978 | Sumner | 405/170 |
| 4,129,010 | 12/1978 | Owen | 405/132 X |
| 4,167,357 | 9/1979 | Assad | 405/132 X |

FOREIGN PATENT DOCUMENTS

| | | | |
|---|---|---|---|
| 2461454 | 7/1976 | Fed. Rep. of Germany | 405/132 |

*Primary Examiner*—David H. Corbin
*Assistant Examiner*—Nancy J. Stodola
*Attorney, Agent, or Firm*—Sughrue, Mion, Zinn, Macpeak and Seas

[57] ABSTRACT

The invention is concerned with a process for bringing a body of water into communication with a tunnel extending under the bed of the body of water. A cavity is excavated under the end of the tunnel adjacent the body of water, to a depth such that the volume of the cavity is at least equal to the volume of the ground forming the roof of the cavity and between the cavity and the bed of the body of water. The roof of the cavity is then collapsed and is received in the cavity.

The invention is particularly useful in the connection of a pipe placed in the tunnel to an installation or pipe which is eventually immersed. For example a pipe may be provided on the bed of the body of water to be connected to a pipe in the tunnel, the connection being made after the cavity roof has been collapsed by introducing a pipe portion between the ends of the immersed and underground pipes.

12 Claims, 13 Drawing Figures

PROCESS FOR BRINGING A BODY OF WATER INTO COMMUNICATION WITH A TUNNEL

The present invention relates to a process for use in making a connection between a body of water, such as a sea or a lake, and a tunnel excavated under the bed of the body of water.

The process is applicable to any construction made on the bed of a sea or of a lake from at least one tunnel, particularly but not exclusively for the purposes of mining or oil drilling or production.

It is known that it is an extremely long and extensive procedure to excavate the bed of a sea or of a lake from a floating structure.

According to the invention there is provided a process for bringing a body of water into communication with a tunnel under the bed of said body of water, comprising excavating beneath the end portion of said tunnel which is adjacent said body of water an underground cavity having a volume at least equal to the volume of the ground between said body of water and said tunnel and above said cavity, and which thus forms the roof of said cavity, and then causing said roof of said cavity to collapse.

The roof is preferably caused to collapse by a plurality of mine blasts carried out with small explosive charges placed in holes which are distributed over the roof and are made from the interior of the tunnel and/or from the surface of the body of water.

The tunnel may be a single tunnel or one of a plurality of tunnels forming a tunnel system. The tunnel and the cavity may be provided, for example, for protecting equipment against the action of icebergs or ice at the bottom of the body of water, and/or for gaining more convenient access to a given immersed location.

Before collapsing the roof, constructions useful for work which is to be carried out, if appropriate, after the roof has been collapsed may be installed in the cavity. The installation plan is advantageously studied with a view to increasing the number of operations which are carried out before the roof is collapsed, and with a view to reducing the number of operations which have to be carried out after the roof has been collapsed.

At least one length of pipe, such as a pipe for conveying hydrocarbons, may be placed in the tunnel, and leaktight shields may be provided between the walls of the tunnel and the pipe in the tunnel, before the roof is collapsed. Preferably at least two leaktight shields are provided and tubes for use in controlling the leaktightness of an intermediate space located between the shields are provided.

The leaktight shields are advantageously anchored in the walls of the tunnel. Likewise the pipe is advantageously anchored in the tunnel.

The cavity is used to receive the debris from the roof after it has been collapsed. However, it is advantageously also used during the installation of certain constructions before the roof is collaped, as has been stated above.

The constructions may comprise, for example, a lining forming a chamber for protecting devices positioned prior to collapsing the roof, or of supports, such as beams, intended for holding devices positioned afterwards, such as a length of pipe which is to be connected to the end of the pipe placed in the tunnel.

This latter case may arise, in particular, if it is desired to provide a pipe between a land installation and a sea installation, when the surface of the seabed in the vicinity of the coast is very undulating, and when it thus appears preferable to join the land installation to a more distant point on the seabed by means of a tunnel, or if it is desired to protect a pipe from dangers created by icebergs and/or bottom ice in certain regions of the world. Placing a pipe in the tunnel obviously presents no difficulty; moveover, various techniques for laying immersed pipes are known. However, the problem which has not yet been solved concerns the manner in which the tunnel is opened into the body of water and a connection, in the zone where the tunnel opens into the body of water, is made with the underground pipe arranged in the tunnel, and, for example, with the immersed pipe, where provided.

Further features and advantages of the invention will become apparent from the following description of embodiments thereof, given by way of example only, with reference to the accompanying drawings.

In the drawings:

FIG. 3 is a section on the line 3—3 of FIG. 2;

FIG. 4 is a section on the line 4—4 of FIG. 2;

FIG. 5 is a perspective view, to an enlarged scale, of a device for protecting the end of the length of underground pipe;

Figure 1:
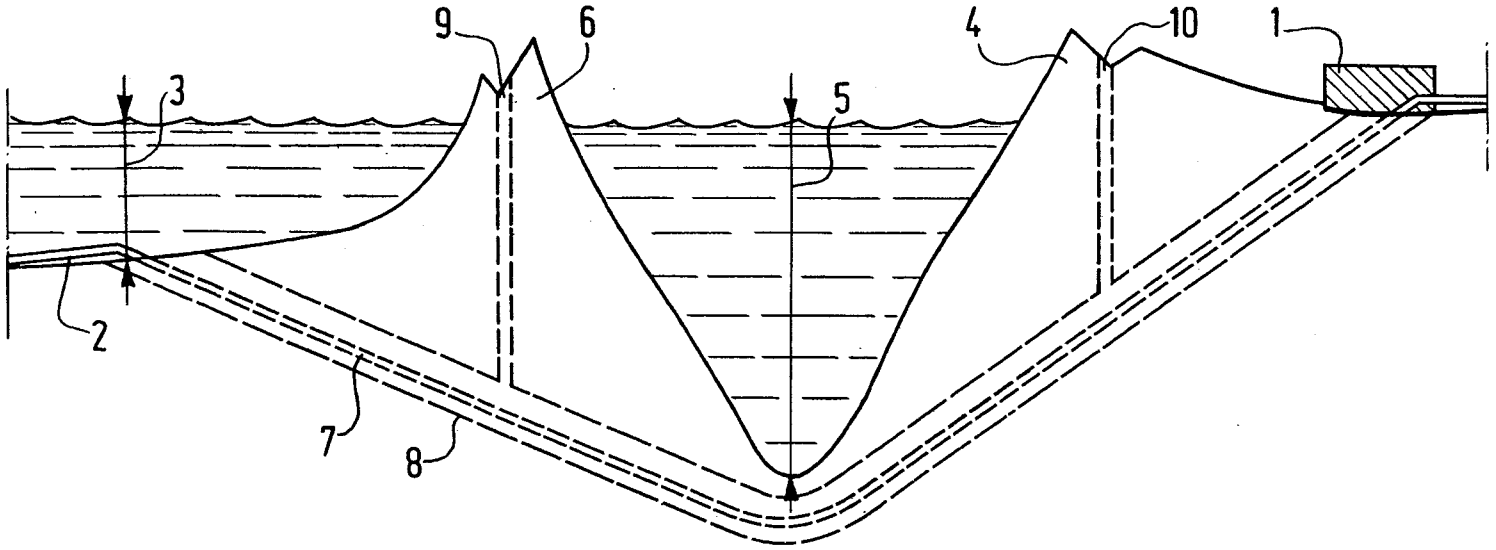
FIG. 1 is a schematic section showing the profile of an underground tunnel.

In FIG. 1, in which the relative proportions have been modified in order to make the drawing easier to interpret, land installations 1 are to be joined to an immersed length of pipe 2 on the seabed at a depth 3 of, for example, about 100 meters and located at a distance of, for example, about 20 kilometers from the installations 1. As the coast 4 is separated from the end of the pipe 2 by a depression 5 having a depth of, for example, 300 meters, and by an island 6, it appears desirable to join the installations 1 to the pipe 2 by means of a pipe 7 arranged underground in a tunnel 8. This tunnel is provided with ventilation shafts such as 9 and 10. In this embodiment, it has been assumed that the work and installations are carried out in hard ground, and no mention will be made of the various well-known techniques which can be used for cutting and consolidating the tunnels depending on the nature of the ground.

Figure 2:
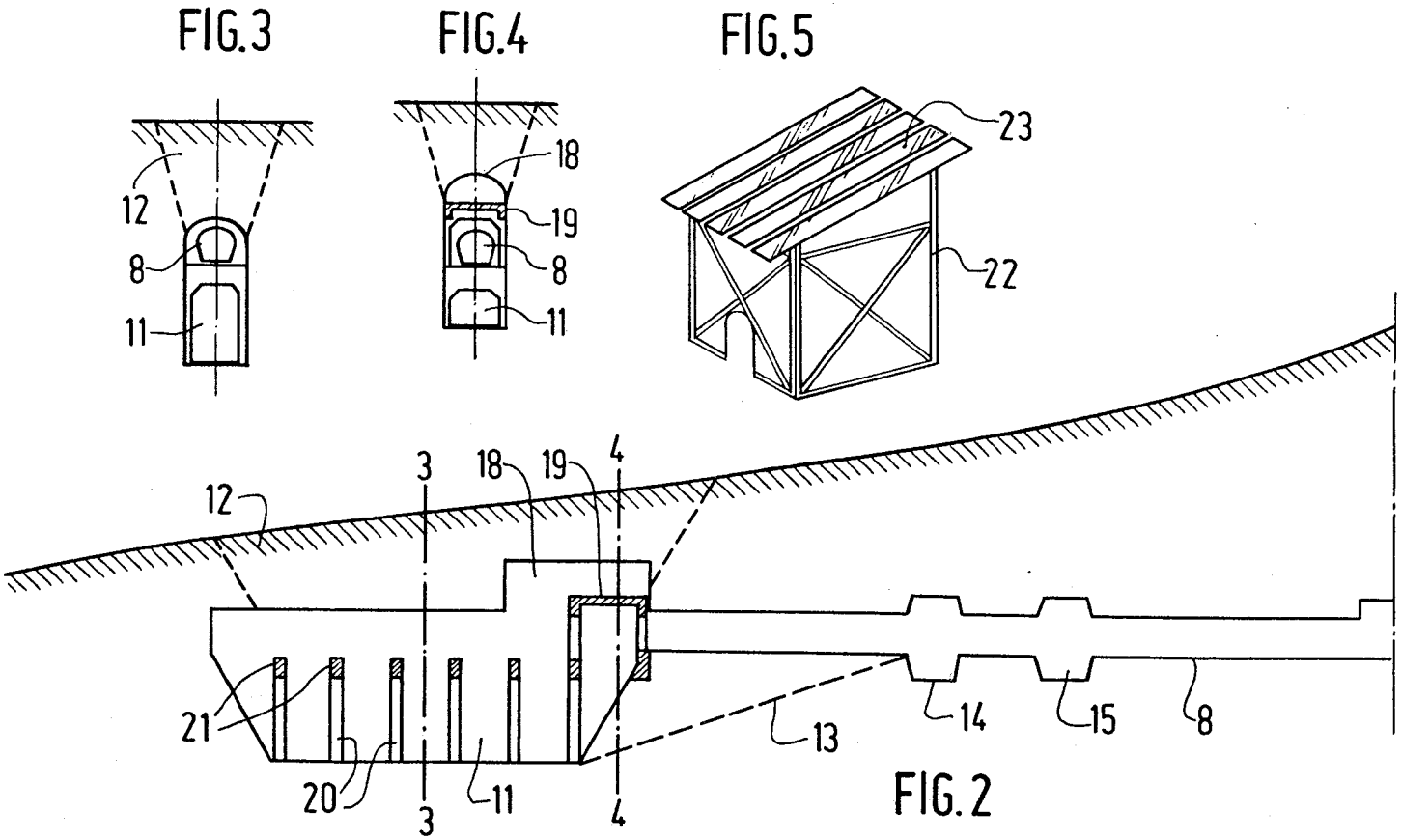
FIG. 2 is a schematic vertical section through the marine end of the tunnel of FIG. 1 and of an underground cavity, before collapsing the roof of the latter, according to a first embodiment of the invention.

According to the invention, shown in FIG. 2, a cavity 11 is excavated at the marine end of the tunnel and under the tunnel, to a sufficient depth for it to have a reception volume at least equal to that of the ground which is between the sea and the tunnel and which constitutes the roof 12 of the cavity, which is subsequently to be collapsed into the cavity. An access ramp 13 is provided to enable vehicles to descend into the cavity 11 from the tunnel 8. Two recesses 14 and 15 are provided in the wall of the tunnel 8 for housing two leaktight shields 16 and 17, which can be seen in FIG. 6. At the entrance to the cavity 11 and above the cavity and the tunnel, an upper chamber 18 is excavated. A retaining framework of beams 19 for holding up the ground when the roof 12 is collapsed is assembled in chamber 18.

The above process thus eliminates the need to discharge, clear and shift debris on the seabed at the excavation site.

A set of pillars 20 supporting beams 21 are installed in the cavity, and these beams provide a stable seating of predetermined and precise configuration for supporting a length of pipe as will be described.

Figure 7:
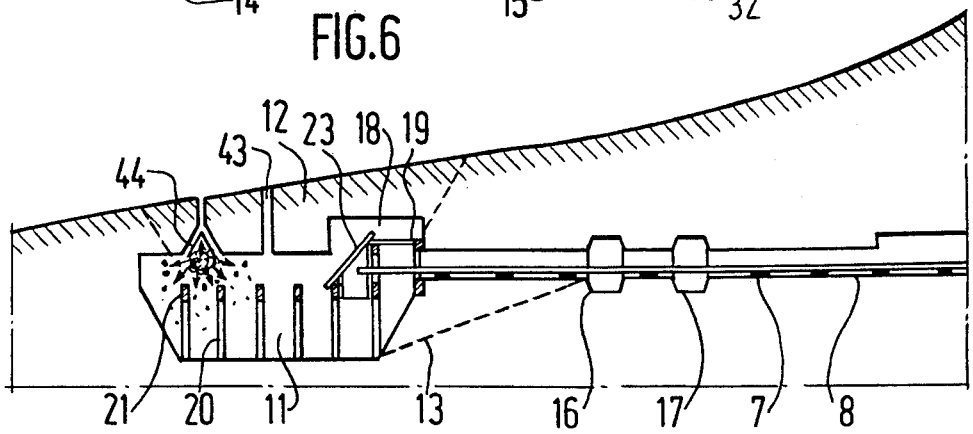
FIG. 7 is a schematic vertical section in the region of the cavity at the moment when the operation for collapsing the roof of the cavity is about to start.
Figure 8:
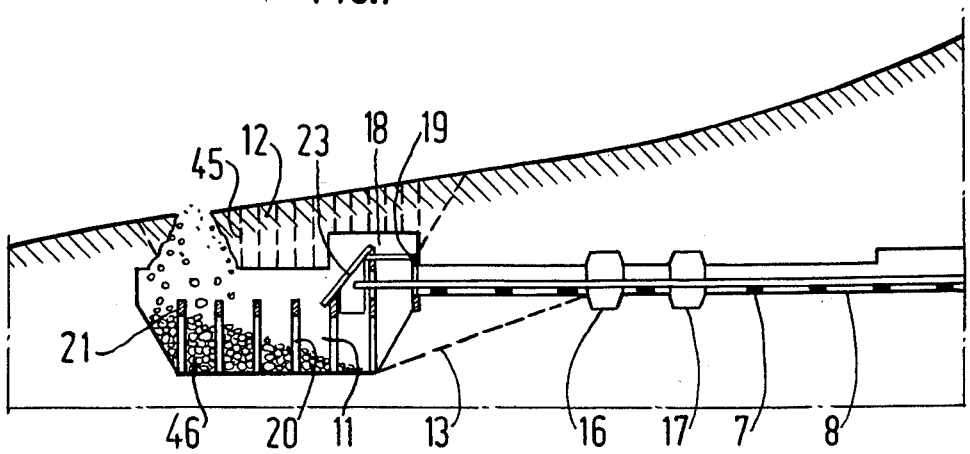
FIG. 8 is an analogous section to that of FIG. 7, shown during the operation of collapsing the roof of the cavity.
Figure 10:
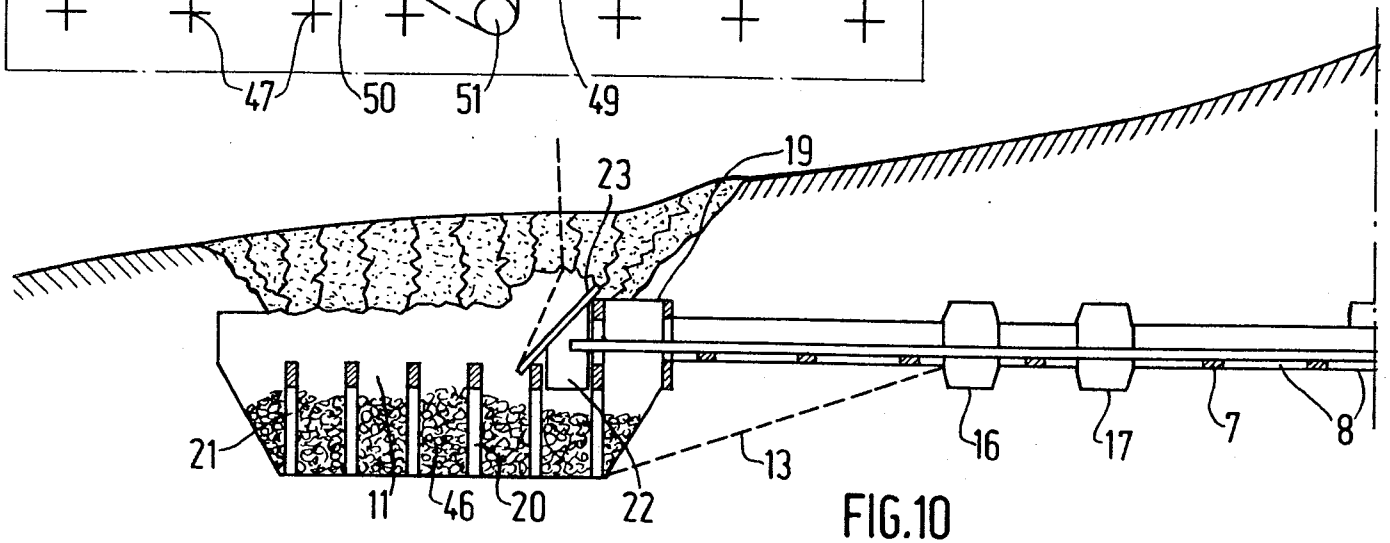
FIG. 10 is an analogous section to that of FIGS. 7 and 8, showing the cavity at the end of the operation of collapsing the roof.

A device for protecting the end of the pipe 7 arranged in the tunnel 8 is also installed in the chamber 18. This device, which is shown to an enlarged scale in FIG. 5, comprises a metal frame 22 which encloses the ends of the pipe 7, and an inclined roofing 23 which protects the end of the pipe against lumps of earth falling in from the roof 12 when the latter is collapsed. The location of the device is shown in FIG. 10 and the roofing 23 is shown in FIGS. 7 and 8. The protective device can eventually be removed simply by pulling from the surface, after hooking up, by divers, with the aid of suitable eyelets.

Figure 6:
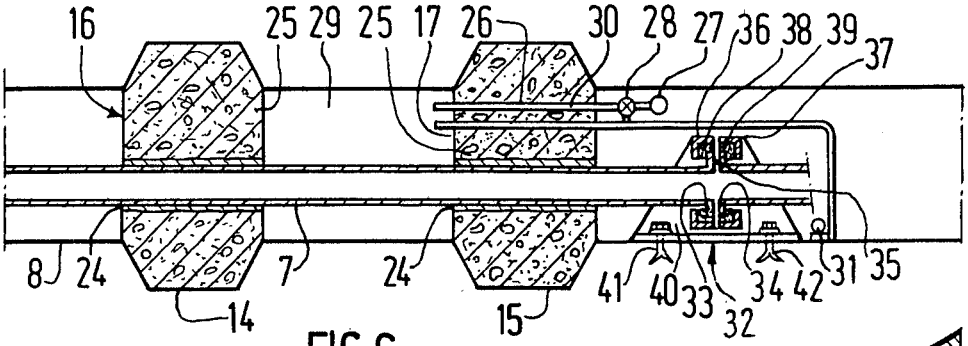
FIG. 6 is a longitudinal section, to an enlarged scale, through a length of tunnel and pipe, showing leak tight shields.

FIG. 6 shows an embodiment of the leaktight shield, it being possible for other suitable blocking devices to be used depending on the nature of the ground and the tunnel. As shown, in the region of the recesses 14,15, the length of pipe 7 is provided, at right-angles to the recesses 14 and 15, with extra thicknesses of weld 24 of non-oxidisable metal, which can be covered with an electrically insulated resin. Between the rough surface thus obtained and the walls of the recesses 14 and 15, a mass of concrete 25 is poured into a casing, which is not shown. Then, to ensure better leaktightness, a few perforations (not shown) may be made in the concrete and a synthetic resin, for example an epoxy resin as used in this type of work, is injected.

The shield 16 is installed at a safe distance from the cavity 11, for example 10 meters, which is sufficient for it to be completely protective from the effects of the operations for collapsing the roof 12 of the cavity 11.

A tube 26 may be provided extending through the shield 17, the tube 26 being joined to a manometer 27 via a three-way valve 28, and may bring the space 29 between the shields into communication with the interior of the tunnel 8 (for removing air from the space if appropriate), or with the manometer. A tube 30 may be provided extending through the shield 17, the tube 30 being connected to a pump 31 for placing the space 29 under pressure. It is thus possible to carryout a leaktightness test by filling the space 29 with a fluid under pressure and by checking that the pressure is maintained in the space 29, If the leaktightness appears inadequate, although it is then no longer possible to act on the shield 16, it is possible to inject synthetic resin into the shield 17. If the desired leaktightness were not achieved in this way, a third leaktight shield could be installed.

The tubes 26 and 30 may either be plugged or maintained during the normal running of the installations, for the purpose of permanently checking the leaktightness of the shield 16.

The anchoring of the shields 16 and 17 in the recesses 14 and 15 enables the shields 16 and 17 to withstand the thrust of the sea after the roof 12 of the cavity has been collapsed. As the pipe 7 is temporarily plugged at its marine end, the pipe is also subject to the thrust of the sea after roof 12 has been collapsed. It is therefore advisable to provide an anchoring 32 for the pipe 7. The anchoring 32, which can be placed in front of or behind the shields, is provided as shown, by two collars 33,34 which are integral with the pipe 7, a gasket 35 being inserted between them, and which are clamped between two flanges 36,37 with the interposition of electrically insulating pieces 38,39, the two flanges 36,37 being carried by a plinth 40 anchored in the floor of the tunnel by means of sealed bolts such as 41,42.

As shown in FIG. 7, before collapsing the roof 12, a positioning hole 43 is made in the roof 12 using a floating drilling apparatus (not shown). The holes intended for the explosive charges may be made from the surface and/or from the interior, before positioning the shields and with the installation of a device for initiating the explosion by remote-control. As the roof consists in this case of rock, at least one hole is made in the zone 44, and at least one blast, directed downwards, is obtained using a small explosive charge. The operation then continues, as shown by the dotted lines 45 in FIG. 8, with small explosive charges so as to clear small lumps which accumulate as masses 46 in the bottom of the cavity 11.

Figure 9:
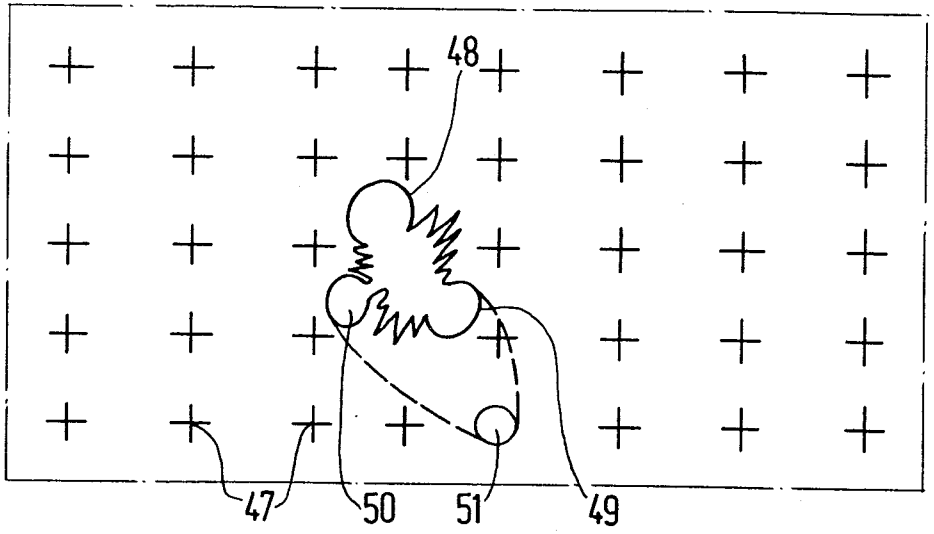
FIG. 9 is a plan view showing the location of explosive charges used for collapsing the roof.

Explosive blasts can be carried out in accordance with various methods which are in themselves known. Various locations which can be used in one of these methods for making holes and carryingout blasts have been shown in FIG. 9 by means of crosses 47. As shown in FIG. 9, a first hole which is a positioning hole, was made at 48, followed by a second hole, which was a blasting hole, at 49, and by a third hole, which was a blasting hole, at 50, whilst a hole 51 is in the course of preparation for the next blast, and the following holes and blasts are made and carried out at the locations marked. When the entire roof has collapsed, the masses 46 cover the whole of the bottom of the cavity 11, as shown in FIG. 10. The protecting device can then be raised to the surface.

Figure 11:
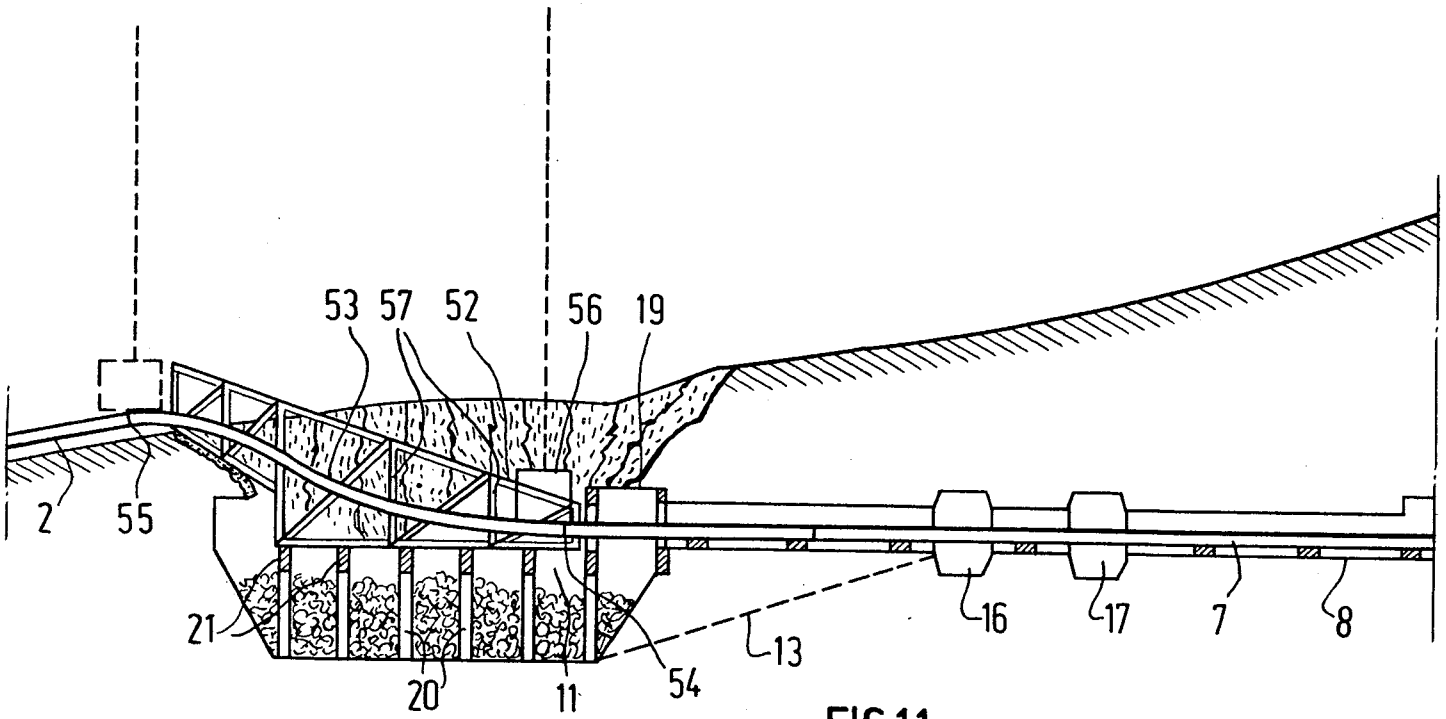
FIG. 11 is a schematic vertical section in the region of the cavity showing the connection of an underground pipe and an immersed pipe.
Figure 12:
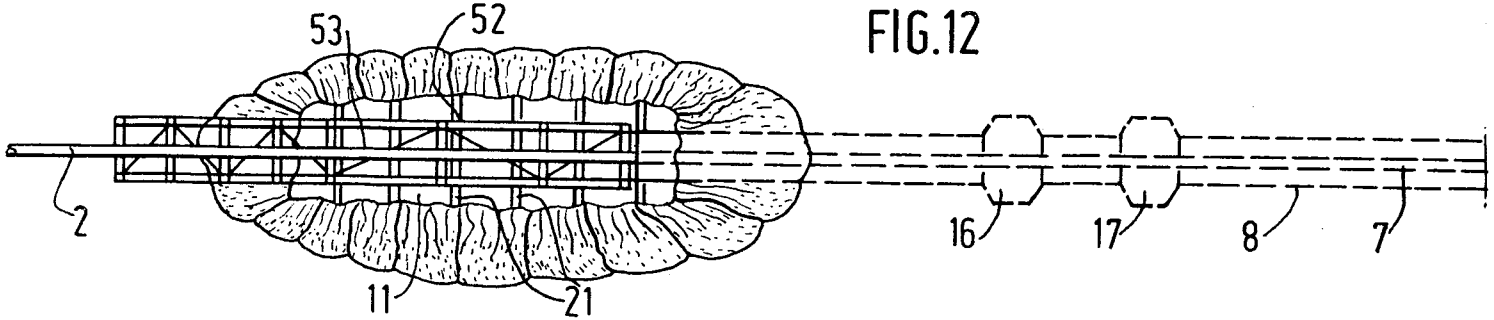
FIG. 12 is a plan view of the same region.

A unit prepared on the surface and comprising, as shown in FIG. 11, an alignment frame 52 and a length of pipe 53, arranged in the frame and held in the frame by means of movable and lockable devices operated by divers, is then lowered and is connected at its ends 54 and 55 to the end of the underground pipe 7 and the end of the immersed pipe 2 respectively. A pressure welding apparatus 56 is first positioned to weld the pipe length 53 to the underground pipe 7 at 54, and it is then moved to join the pipe length 53 to the end of the first section of the immersed pipe 2 at 55.

The frame 52 and the length of pipe 53 have configurations corresponding to the characteristics of the site resulting from the work carried out previously and from the collapsing of the roof 12. In particular, provision is made for the frame to fit onto the beams 21. It is simplified as much as possible because it preferably remains in position, at least for the most part, and therefore constitutes a lost part. The frame comprises an enclosure of protection bars 57 forming a cage, inside which personnel can work with protection from falls of rock which may occur.

Figure 13:
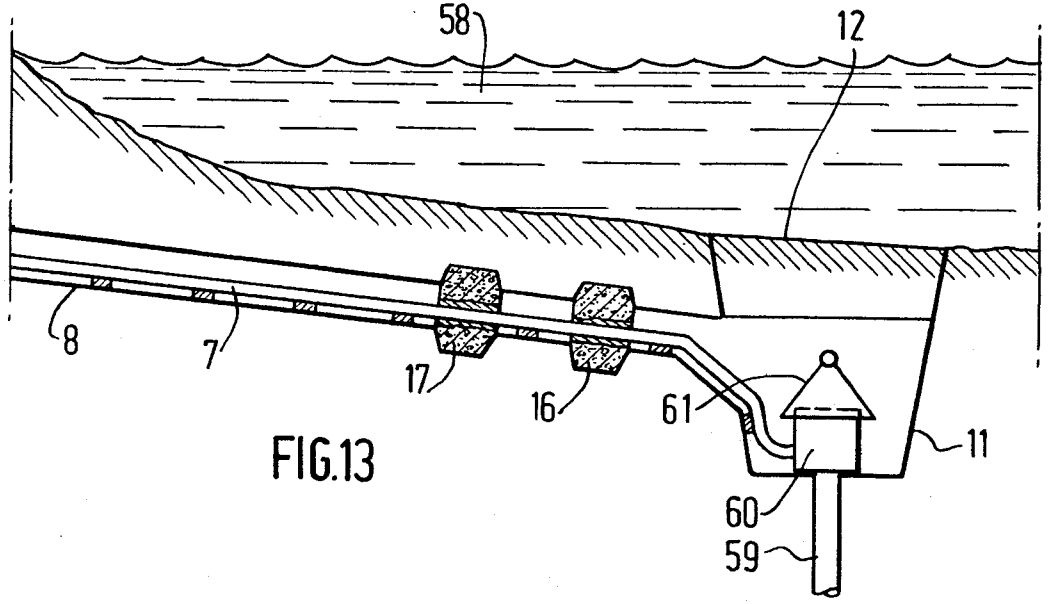
FIG. 13 is a longitudinal section showing a length of a tunnel and of a drilling well, in another embodiment according to the invention.

In the embodiments illustrated in FIG. 13, there is again shown a tunnel 8 with a pipe 7, which in fact represents both a flow line bundle and remote-control and telesystem cables for hydraulic connectors, shields 16 and 17 and a cavity 11 with a roof 12. The body of water is a sea 58 in which there is frequently bottom ice. For example, oil drilling, or collection, such as that indicated at 59, is to be carried out.

Before the roof 12 is collapsed, that is to say before the oil drilling or collection, not only the pipe 7 but also a concrete lining 60, forming a chamber for protecting the sealing blocks and the automatic connectors for the head of the underground world, are installed, the concrete lining being surmounted by a detachable conical steel cover 61 which protects all the devices contained in the protection chamber during the collapsing of the roof 12, and which is then raised to the surface before the oil drilling or collection.

Of course, the invention is not intended to be limited to the embodiments which have been described above but extends to all modifications which can be applied thereto within the scope of the invention.

What is claimed is:

1. A process for establishing communication between an end of a length of pipe and a body of overlying water, comprising the steps of:

(a) excavating an elongate tunnel (8) under the bed of said body of water, (b) excavating an underground cavity (11) beneath an end portion of said tunnel adjacent said body of water, said cavity having a volume at least equal to the volume of the ground (12) located between the bed of said body of water and the end portion of said tunnel above said cavity, said volume of ground forming a roof of said cavity, (c) installing a length of pipe (7) in said tunnel such that an end of the length of pipe is disposed at said end portion of said tunnel at an entrance to said cavity, (d) installing a chamber (60) in said cavity for protecting devices for the head of an underground well, (e) installing a removable roof (61) over said chamber, (f) constructing at least one leaktight shield (16) between the wall of said tunnel and said length of pipe at a position remote from said cavity, and (g) collapsing the volume of ground forming said roof into said cavity such that the end of said length of pipe becomes immersed in and thus openly communicates with said body of water.

2. A process for establishing communication between an end of a length of pipe and a body of overlying water, comprising the steps of:

(a) excavating an elongate tunnel (8) under the bed of said body of water, (b) excavating an underground cavity (11) beneath an end portion of said tunnel adjacent said body of water, said cavity having a volume at least equal to the volume of the ground (12) located between the bed of said body of water and the end portion of said tunnel above said cavity, said volume of ground forming a roof of said cavity, (c) installing a length of pipe (7) in said tunnel such that an end of the length of pipe is disposed at said end portion of said tunnel at an entrance to said cavity, (d) installing at least one detachable device (23) for protecting devices placed under said roof, (e) constructing at least one leaktight shield (16) between the wall of said tunnel and said length of pipe at a position remote from said cavity, (f) collapsing the volume of ground forming said roof into said cavity such that the end of said length of pipe becomes immersed in and thus openly communicates with said body of water, and (g) removing said detachable device.

3. A process according to claim 1 or 2, further comprising, before said shield is constructed, installing constructions in said cavity useful for connecting work to be carried out on the end of said length of pipe after the roof has been collapsed.

4. A process according to claim 1 or 2, further comprising, before said shield is constructed, installing a chamber (60) in said cavity for protecting devices for the head of an underground well, and installing a removable roof (61) over said chamber.

5. A process according to claim 3, wherein said constructions comprise beams (20, 21) for supporting devices which are to be positioned after said roof has been collapsed.

6. A process according to claim 1, further comprising, before said shield is constructed, installing at least one detachable device (23) for protecting devices placed under said roof, and removing said device after said roof has been collapsed.

7. A process according to claim 1 or 2, further comprising, before said shield is constructed, installing a framework of retaining beams (19), which is intended to hold up the ground when said roof is collapsed, at the entrance of said tunnel in said cavity.

8. A process according to claim 1 or 2, further comprising, constructing at least two spaced apart leaktight shields, and installing tubes (26, 30) for use in controlling the leaktightness between said shields.

9. A process according to claim 1 or 2, further comprising, before said roof is collapsed, anchoring each said leaktight shield in the wall of said tunnel.

10. A process according to claim 1 or 2, further comprising, before said roof is collapsed, anchoring said pipe in said tunnel.

11. A process according to claim 5, further comprising, after said roof is collapsed, lowering onto said beams a frame (52) for aligning pipes, which contains a length of immersed pipe (53) to be connected to the end of said length of pipe.

12. A process according to claim 11, wherein said beams are provided to receive permanently at least a substantial part of said alignment frame.

* * * * *